US006385928B1

(12) United States Patent
Paulshus et al.

(10) Patent No.: US 6,385,928 B1
(45) Date of Patent: May 14, 2002

(54) TENSION MEMBER

(75) Inventors: Bjørn Paulshus, Skedsmokorset; Per-Ola Baalerud, Stabekk, both of (NO)

(73) Assignee: Kvaener Oilfield Products A.S., Olso (NO)

( * ) Notice: Subject to any disclaimer, the term of this patent is extended or adjusted under 35 U.S.C. 154(b) by 0 days.

(21) Appl. No.: 09/367,925

(22) PCT Filed: Mar. 6, 1998

(86) PCT No.: PCT/NO98/00076

§ 371 Date: Oct. 12, 1999

§ 102(e) Date: Oct. 12, 1999

(87) PCT Pub. No.: WO98/39513

PCT Pub. Date: Sep. 11, 1998

(30) Foreign Application Priority Data

Mar. 7, 1997 (NO) ..... 971052

(51) Int. Cl.[7] ..... E04C 5/08

(52) U.S. Cl. ..... 52/223.13; 52/223.14; 52/687; 52/223.8; 52/309.16; 428/397; 428/377; 428/374; 428/373

(58) Field of Search ..... 405/224.1; 428/397, 428/377, 374, 373; 52/223.1, 223.8, 309.16

(56) References Cited

U.S. PATENT DOCUMENTS

| | | | | | |
|---|---|---|---|---|---|
| 3,088,269 | A | | 5/1963 | Shields | |
| 4,275,117 | A | * | 6/1981 | Crandall | 428/373 |
| 4,498,282 | A | * | 2/1985 | Graetz | 428/379 |
| 4,557,007 | A | * | 12/1985 | Daiguji | 52/230 |
| 4,718,965 | A | * | 1/1988 | Finsterwalder | 52/230 |
| 4,776,161 | A | * | 10/1988 | Sato | 428/377 |
| 4,848,052 | A | | 7/1989 | Nützel | |
| 4,960,641 | A | * | 10/1990 | Hanaoka | 428/383 |
| 5,573,852 | A | * | 11/1996 | Thal | 428/378 |
| 6,007,911 | A | * | 12/1999 | Bowen | 428/373 |
| 6,007,912 | A | * | 12/1999 | Doujak | 428/379 |

FOREIGN PATENT DOCUMENTS

EP 0685592 12/1995

* cited by examiner

*Primary Examiner*—Beth A. Stephan
*Assistant Examiner*—Kevin McDermott
(74) *Attorney, Agent, or Firm*—Ladas & Parry

(57) ABSTRACT

A tension member, for use as a tendon or tether for a tension leg platform consisting of a plurality of carbon fiber filaments (6) gathered into a plurality of strands (5) in which the filaments (6) run against one another, around which strands there is arranged a sheath (16). The tension member comprises pressure-resisting spacers (7) having recesses (9, 11, 12, 14; 25, 26, 28, 31) wherein the strands (5) are laid singly so that they can move in the longitudinal direction unobstructed by each other and the spacers (7).

18 Claims, 4 Drawing Sheets

TENSION MEMBER

The present invention relates to a tension member and a method for installing the tension member as a tendon or tether for a tension leg platform. The tension member of the invention is intended primarily to be used in connection with tendons for tension leg platforms, but other applications are also possible, such as stays or wires for bridges, (e.g., suspension bridges or cable-stayed bridges), the bracing of tunnels or other applications where there is a need for a lightweight, strong wire or stay. The invention is therefore not limited to the application described below.

Tension leg platforms are widely used in drilling and production on oil fields where for various reasons it is not possible or financially viable to install a fixed platform, and where it would not be expedient to use a floating platform moored by means of anchors and anchor chains.

Tension leg platforms are in principle floating platforms, where, however, instead of a slack mooring by means of anchors and anchor chains, tendons extend from the platform approximately vertically down to an anchorage on the seafloor. The tendons are put under considerable tension to ensure that the platform stays as much as possible in the same position relative to the seafloor. The stable position of the platform is of great advantage for both drilling and production. However, this makes heavy demands on the tendons used, their attachment to the platform and the anchorage on the seafloor.

Today's tendon tension legs consist of steel pipes in sections. The sections may be of different lengths and different diameters and have different wall thicknesses. Insofar as strength is concerned, it is an advantage for the steel pipes to have a large wall thickness, but as regards weight and thus also the load on the attachment to the platform, it is an advantage if the wall thickness is small. Wall thickness will therefore always be chosen as a compromise between strength and weight. These steel tendons function well to moderate depths, i.e., depths of a few hundred meters. However, oil and gas production is now taking place at ever-greater depths, often up to 2000 m. Under such conditions heavy demands are made on the strength of the tendons, and tendons of steel are not usable. On account of the increased strength requirement, the wall thickness would have to be very large and the pipes would thus be extremely heavy. To facilitate transport, they would also have to consist of very many sections which would need to be joined together during installation. The tendons would thus have a considerable number of joints, which would also add to the substantial increase in weight. To counteract this increase in weight it would therefore be necessary to equip the tendons with a large number of floats. All this would result in a very costly and heavy installation.

Carbon fibers, with their low weight and high tensile strength, have already been used in various areas in connection with oil and gas recovery, for example, as hoisting cable for great depths, where the weight of a hoisting cable in steel would create problems.

According to the present invention, one of the objects is to exploit the advantageous properties of the carbon fibers, in particular their great strength when subjected to tensile stress, also when used in tendons. However, carbon fibers also have one considerable negative property; they have very small breaking strength when subjected to shearing stress. When constructing a tendon consisting of carbon fibers, this will have to be taken into account.

During the development of the present invention ideas were taken from the Applicant's own pipe bundle cable as described in NO 155826. In this publication, several smaller piplines are placed in a bundle in a way that makes it possible for them to move axially with respect to each other. The cable is, however, not able to endure large tensions.

NO 174940 describes a method and a machine for making a cable string of several tubings or cables. This cable string includes a center pipe. This cable string is will not endure large tensions.

EP 685 592 describes a method for separating individual strands in a steel wire to prevent wear and increase the cross section. The plastic elements between the strands will be squeezed when the cable is loaded, and thus contact between the strands is prevented. The strands are not freely axially moveable relative to each other because of this squeezing.

FR 2078622 also describes a steel wire where a filler is put in to separate the individual wires. Free axial movement of the strands is difficult because direct contact between the strands occurs.

U.S. Pat. No. 3,088,269 describes a method for producing a steel wire with a smooth surface for use in ropeways etc. Filler elements are laid in between the strands to fix these and keep them separated from each other. Free movement between the strands is not possible, since the aim is to obtain a squeezing between the strands and the filler elements.

According to the present invention, one of the objects is to provide a tendon of preferably carbon fibers, which can be used for tension leg platforms at great depths, where the carbon fibers are protected against shearing stress. However, other fiber materials having approximately the same properties as carbon fibers may also be used, for example, glass fibers.

The invention will now be described in more detail with reference to the accompanying drawings, wherein.

Figure 1:
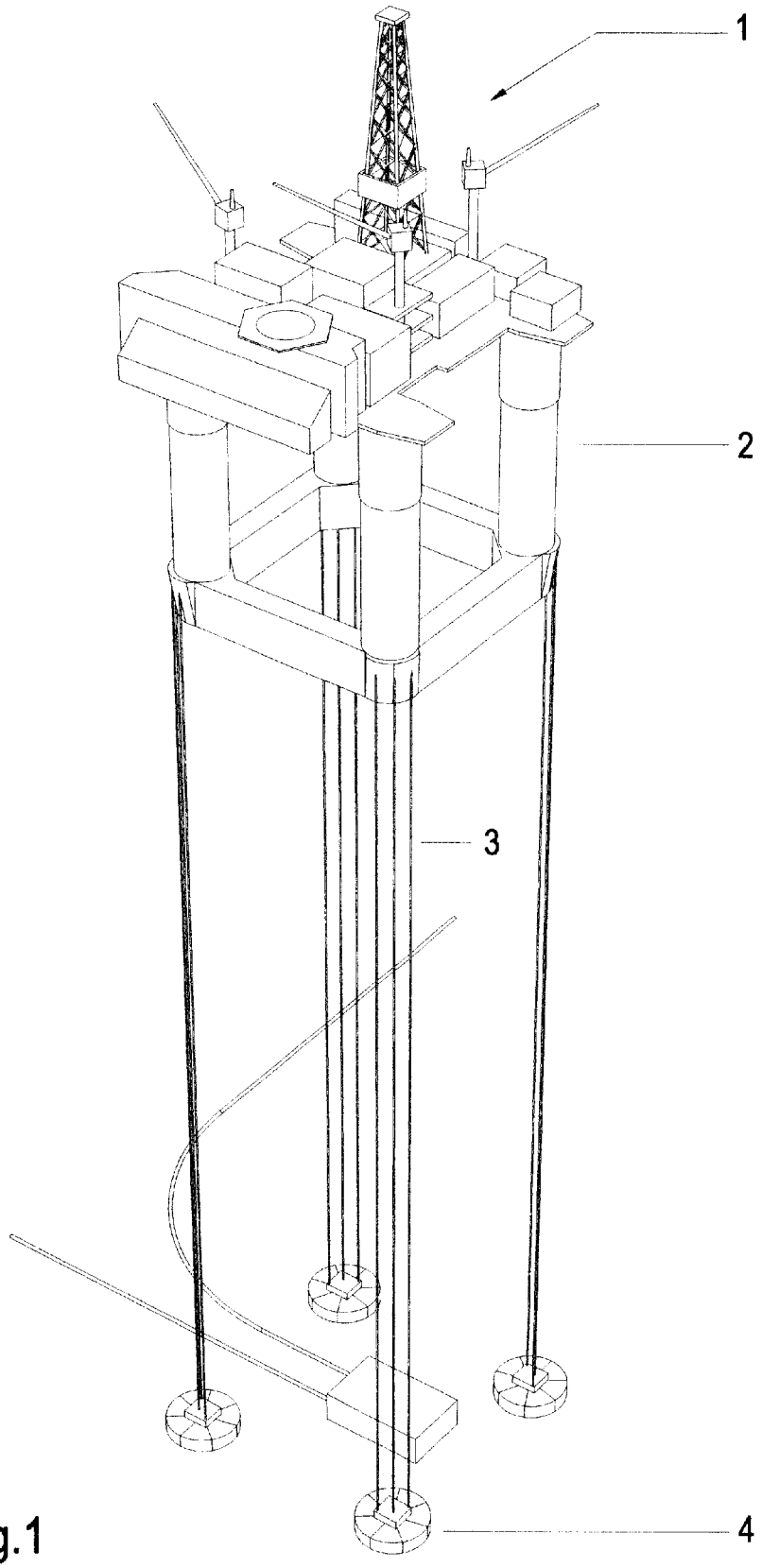
FIG. 1 is a perspective view of a tension leg platform.

FIG. 1 shows a tension leg platform 1. It consists of a floating platform 2, a plurality of tendons 3 and anchorages 4 on the seafloor for anchoring the tendons 3. The tendons 3 are preferably attached to the comers of the platform 2, for example, three tendons 3 in each corner. By ensuring an excess of buoyancy in the platform 2, the tendons 3 are put under considerable tension. Owing to this, the platform 2 will move very little relative to the seafloor.

According to the invention, a new tendon is constructed, which is based on the use of carbon fibers. Carbon fiber-based tendons have many advantages over the conventional tendons consisting of steel pipes. Firstly, they are considerably lighter, approximately one fifth of the net weight of the steel, and secondly they can be coiled up for transport. However, despite their great axial strength, carbon fibers are very susceptible to shearing stress. It is therefore essential to protect the fiber filaments against such shearing stress. When the carbon fibers are twisted into strands it is essential that the fiber filaments remain stable relative to one another and do not chafe against one another during coiling or use. This can be achieved by laying the filaments in, e.g., a closely packed hexagonal configuration, Warrington Seal, etc. However, if one single strand were to be strong enough to be used alone as a tension member in a tendon, it would have to be of considerable diameter, and it would then be so rigid that it would be difficult to coil. In a tension member for use as a tendon it will be necessary to use several strands, which must be twisted about a common longitudinal axis. The filaments in adjacent strands will thus cross one another and press against one another. This causes shearing stress in the outer filaments of the strands. These could break as a result of this, especially when there is movement between the strands.

According to the invention, a tension member is provided wherein the strands are spaced apart and allowed to move relative to one another without any chafing occurring between the filaments.

Figure 2:
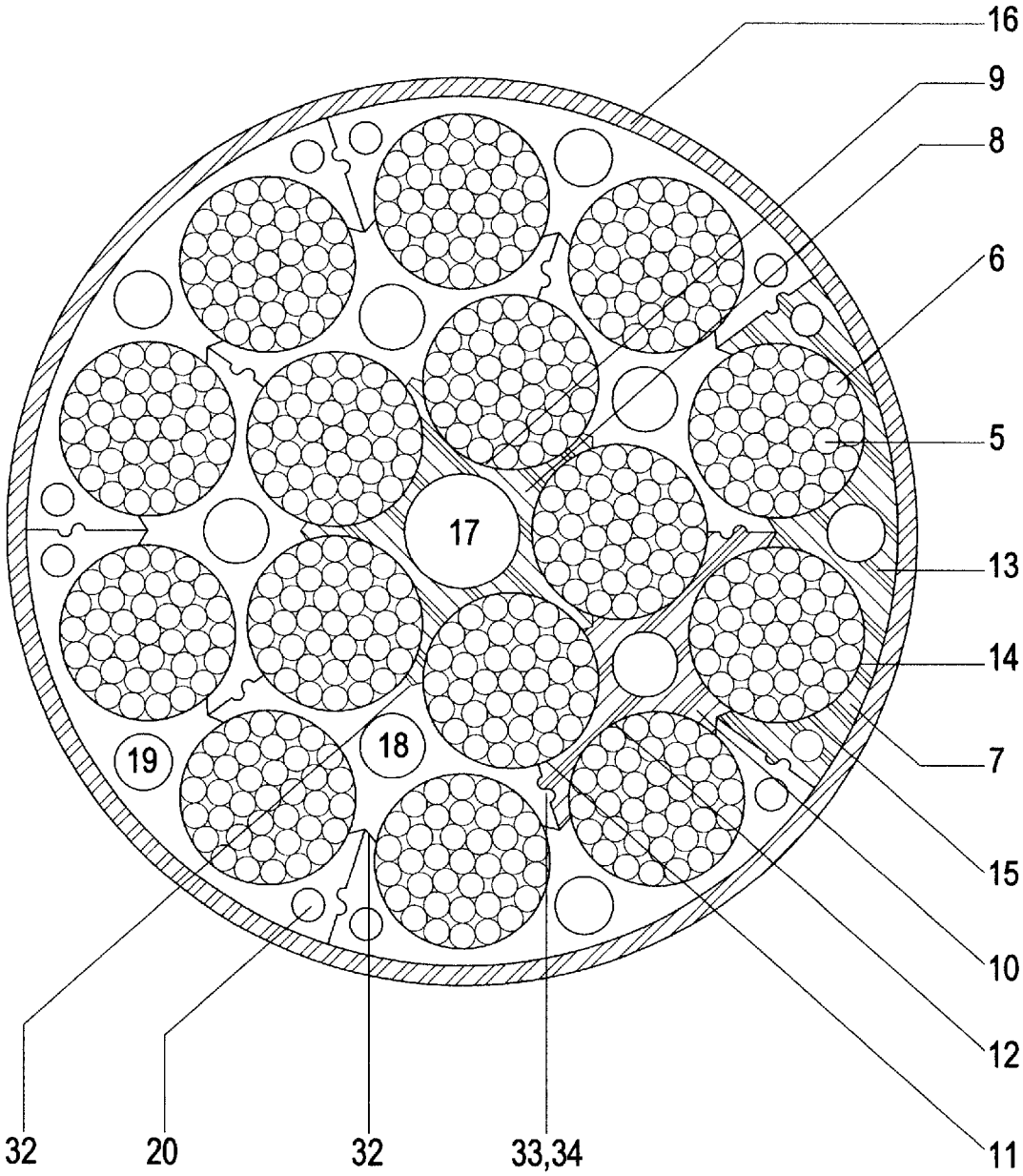
FIG. 2 is a sectional view through a tension member according to a first embodiment of the invention.

FIG. 2 shows how this is accomplished according to a first embodiment of the invention. The tension member according to FIG. 2 consists of bundles or strands 5, which in turn consist of a substantial number of single filaments 6. The single filaments 6 within each strand 5 are preferably twisted about a common center axis. The tension member consists of a plurality of strands 5 which may be positioned relative to one another in different ways.

Within each strand 5 there is a minimum of movement between the single filaments 6. However, there may be considerable movement between each strand. These movements result in chafing of the strands against one another. Over time this will result in stress-exposed filaments snapping and the tension member being weakened. To avoid this, pressure-resisting spacers 7 are provided between the strands 5. According to the embodiment in FIG. 2 these spacers 7 are of three different types. In the center of the tension member there is located a spacer 8, about the periphery of which five recesses 9 are formed. Beyond this central spacer 8 there are provided five spacers 10, which comprise inward facing recesses 11 and outward facing recesses 12. The recesses 11 in the spacer 10 and the recesses 9 in the spacer 8 are positioned and adapted to one another so that longitudinal channels are formed that are tailored to the shape of a strand 5.

Beyond this again there are provided outer spacers 13, in which there are formed inward facing recesses 14. These recesses are adapted to the outer recesses of the spacers 10 so that longitudinal channels 15 are formed for further strands 5.

The faces in the recesses 9, 11, 12 and 14 of the spacers 7 are smooth so that the strands 5 can move in the channels without any shearing stress occurring in the filaments 6. The spacers 7 also help to hold the strands in place relative to one another, for example, in a helical winding about the center axis of the tension member.

The spacers 7 are made having inclined faces 32 which form respectively a V-shaped groove in or a crest in one spacer 8 or when two spacers 10 or 13 are placed against one another. This means that the spacers 7 are held in place relative to one another without slipping. For additional retention, the spacers may be equipped with bosses 33 having corresponding recesses 34.

Outermost the tension member is equipped with an enveloping sheath 16 to hold the spacers 7 in place and to protect the tension member against external stress.

As shown, the spacers 7 may be equipped with cavities 17, 18, 19 and 20, which cavities can accommodate, for example, water during installation in order to provide a greater internal pressure in the tension member at great depths. In dry state, the cavities 17, 18, 19 and 20 will contribute to the reduction in weight.

The spacers 7 may extend along the entire length of the tension member, but may also expediently be divided into sections.

Figure 3:
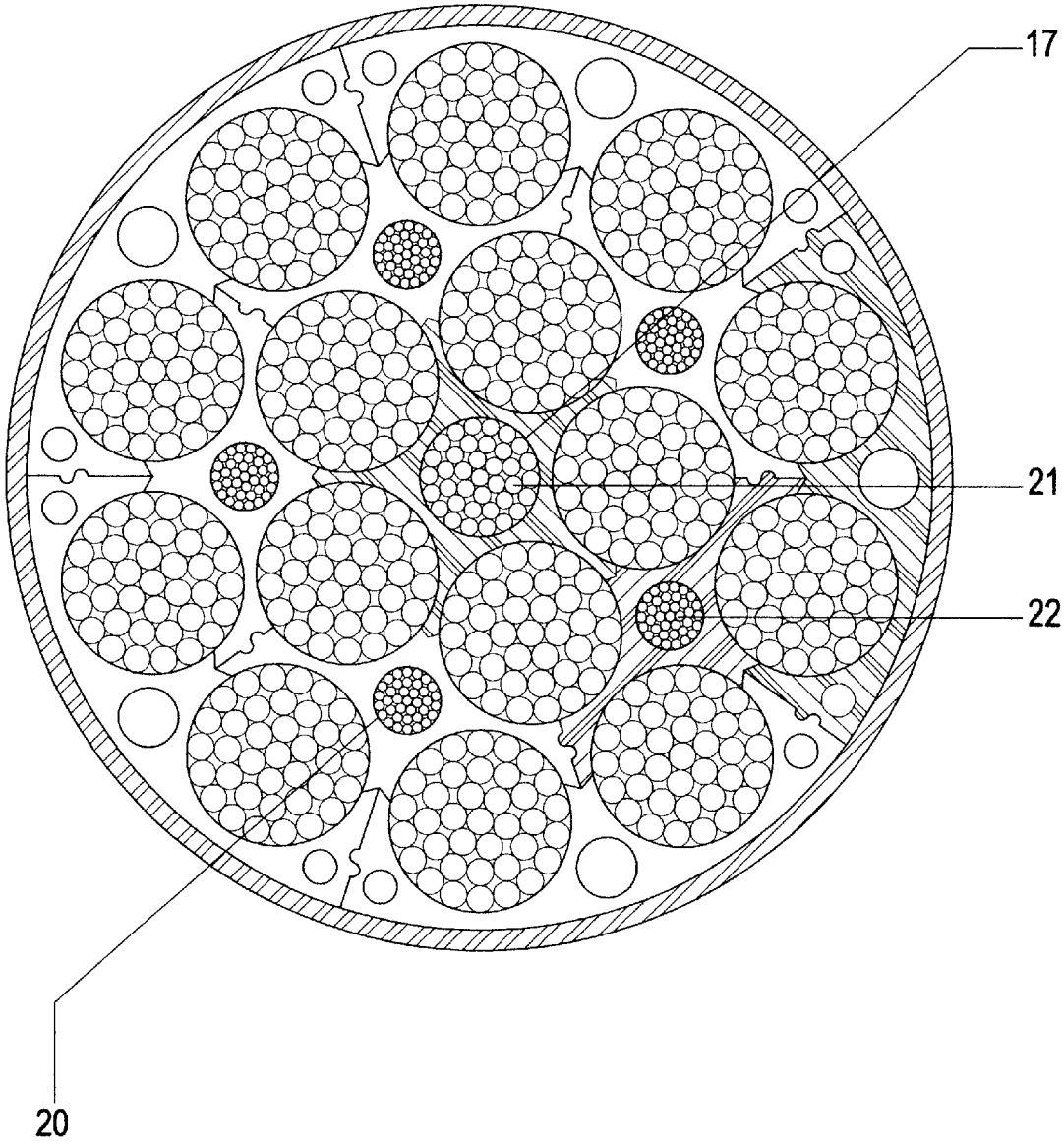
FIG. 3 is a sectional view through a tension member according to a second embodiment of the invention.

FIG. 3 shows a second embodiment of the invention, which is identical to the embodiment in FIG. 2, except that extra strands 21 and 22 have been placed in the cavities 17 and 18. This helps to add to the strength of the tension member.

Figure 4:
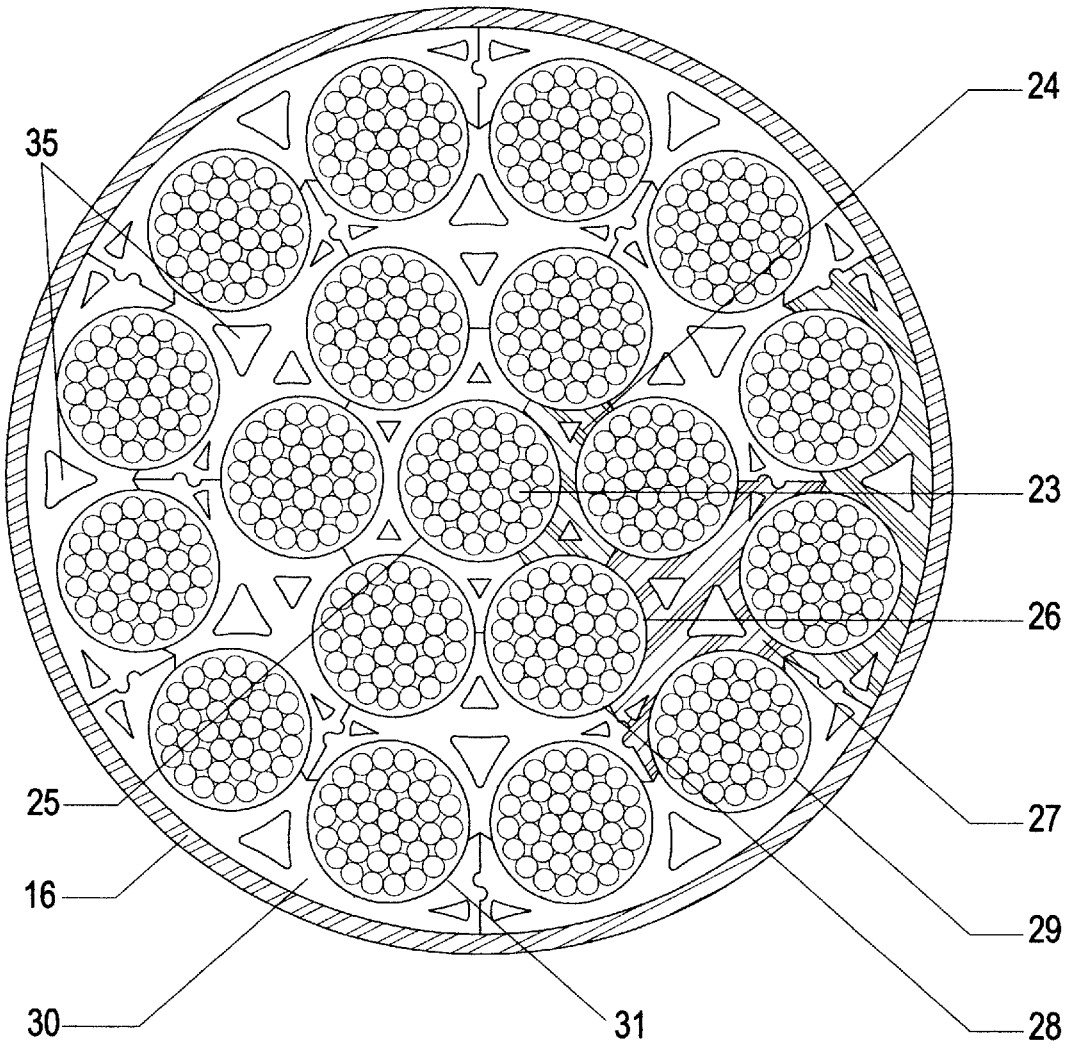
FIG. 4 is a sectional view through a tension member according to a third embodiment of the invention.

FIG. 4 shows a third embodiment of the invention. Here, instead of a center spacer, a strand 23 is placed in the center of the tension member. Around this strand 23 there are provided spacers 24, comprising recesses 25, 26 respectively on the inside and the outside. In all, three spacers 24 are placed around the center strand 23, and each recess 25 forms one third of a strand circumference. Beyond these spacers 24 there is provided an additional ring of spacers 27, which comprise inner recesses 28 and outer recesses 29. The recesses 28 are adapted to the recesses 26 of the spacers 24 so that channels are formed here for receiving strands 5. Outside this ring of spacers there are provided additional spacers 30, which in turn comprise recesses 31 adapted to the recesses 29 of the spacers 27, so that channels for receiving strands 5 are formed. As in the exemplary embodiments described previously, here too, a sheath 16 is provided outermost on the tension member.

As can be seen from FIG. 4, cavities 35 are formed in the spacers which in contrast to the cavities 17, 18, 19 and 20 in the preceding examples, are not round but triangular in shape. To allow water into the cavities 17, 18, 19, 20 or 35, these are open at least at one end of the tension member. Alternatively or in addition, passages (not shown) may be formed which lead into the cavities also at different points along the tension member.

When installing the tension member of the invention as a tendon for a tension leg platform, the tendon is coiled up on a drum and transported to the installation site by means of an installation vessel. The tendon is uncoiled, one end thereof being lowered down towards an anchorage on the seafloor. Here, the lower end of the tendon is anchored to an anchorage constructed and fixed on the seafloor. During the lowering, the cavity of the tendon may be filled with water in order to obtain a greater pressure equilibrium between the interior of the tendon and its surroundings. Optionally, the lower end of the tendon may be filled with water and the upper part with air, so that a certain buoyancy is provided in the upper part of the tendon. Once the tendon has been secured to the anchorage on the seafloor, the platform is put in place and the tendon is secured to the platform. The tendon is then tensioned to the desired tension, for example, by increasing the buoyancy of the platform or with the aid of tensioners.

What is claimed is:

1. A tension member, comprising a plurality of fiber filaments (6) gathered into a plurality of strands (5) in which strands the filaments are placed in close relationship to one another, around which strands (5) there is provided a sheath (16), and pressure-resisting spacers (7) extending along the entire length of the tension member, either continuously or divided into sections, the spacers having recesses (9, 11, 12, 14 25, 26, 28, 31) receiving respective strands (5), whereby the strands can move in the longitudinal direction unobstructed by each other and the spacers (7), characterised in that at least some of the recesses (9, 11, 12, 14; 25, 26, 28, 31) extend in a helical fashion along the length of the tension member.

2. A tension member according to claim 1, characterised in that the spacers (7) are arranged with the recesses (9, 11, 12, 14; 25, 26, 28, 31) facing each other so that longitudinal channels are formed which have a cross-sectional form adapted to the cross-sectional form of the strands (5).

3. A tension member according to claim 1, characterised in that the spacers (7, 8, 10) comprise longitudinal cavities (17, 18, 19, 20; 35) accommodating a pressure-equalising medium for equalising pressure with that of the surroundings, for accommodating additional strands (18, 21) and/or for accommodating signal cables.

4. A tension member according to claim 1, characterised in that one of the strands (21, 23) is provided along the longitudinal center axis of the tension member.

5. A tension member according to claim 1, characterised in that one of the spacers (8) is provided along the longitudinal center axis of the tension member.

6. A tension member comprising:

filaments gathered into strands; and at least two pressure-resisting spacers respectively having recesses facing each other to form longitudinal channels respectively receiving the strands, whereby the strands can move longitudinally unobstructed by each other or the spacers, characterised in that at least some of the recesses (9, 11, 12, 14; 25, 26, 28, 31) extend in a helical fashion along the length of the tension member.

7. A tension member according to claim 6, wherein the spacers comprise longitudinal cavities for one or more of weight reduction and accommodating a pressure-equalising medium, additional strands or signal cables.

8. A tension member, comprising a plurality of fiber filaments (6) gathered into a plurality of strands (5) in which strands the filaments are placed in close relationship to one another, around which strands (5) there is provided a sheath (16), and pressure-resisting spacers (7) extending along the entire length of the tension member, either continuously or divided into sections, the spacers having recesses (9, 11, 12, 14 25, 26, 28, 31) receiving respective strands (5), whereby the strands can move in the longitudinal direction unobstructed by each other and the spacers (7), characterised in that the spacers (7) are arranged with the recesses (9, 11, 12, 14; 25, 26, 28, 31) facing each other so that longitudinal channels are formed which have a cross-sectional form adapted to the cross-sectional form of the strands (5), and the spacers (7, 8, 10) comprise longitudinal cavities (17, 18, 19, 20, 35) for accommodating a pressure-equalising medium for equalising pressure with that of the surroundings, for accommodating additional strands (18, 31) and/or for accommodating signal cables.

9. A tension member according to claim 2, characterised in that the spacers (7, 8, 10) comprises longitudinal cavities (17, 18, 19, 20, 35) for accommodating a pressure-equalising medium for equalising pressure with that of the surroundings, for accommodating additional strands (18, 31) and/or for accommodating signal cables.

10. A tension member according to claim 2, characterised in that one of the strands (21, 23) is provided along the longitudinal center axis of the tension member.

11. A tension member, comprising a plurality of fiber filaments (6) gathered into a plurality of strands (5) in which strands the filaments are placed in close relationship to one another, around which strands (5) there is provided a sheath (16), and pressure-resisting spacers (7) extending along the entire length of the tension member, either continuously or divided into sections, the spacers having recesses (9, 11, 12, 14 25, 26, 28, 31) receiving respective strands (5), whereby the strands can move in the longitudinal direction unobstructed by each other and the spacers (7), characterised in that the spacers (7, 8, 10) comprise longitudinal cavities (17, 18, 19, 20; 35) accommodating a pressure-equalising medium for equalising pressure with that of the surroundings, for accommodating additional strands (18, 21) and/or for accommodating signal cables, and one of the strands (21, 23) is provided along the longitudinal center axis of the tension member.

12. A tension member according to claim 9, characterised in that one of the strands (21, 23) is provided along the longitudinal center axis of the tension member.

13. A tension member 3, comprising a plurality of fiber filaments (6) gathered into a plurality of strands (5) in which strands the filaments are placed in close relationship to one another, around which strands (5) there is provided a sheath (16), and pressure-resisting spacers (7) extending along the entire length of the tension member, either continuously or divided into sections, the spacers having recesses (9, 11, 12, 14 25, 26, 28, 31) receiving respective strands (5), whereby the strands can move in the longitudinal direction unobstructed by each other and the spacers (7), characterised in that the spacers (7, 8, 10) comprise longitudinal cavities (17, 18, 19, 20; 35) accommodating a pressure-equalising medium for equalising pressure with that of the surroundings, for accommodating additional strands (18, 21) and/or for accommodating signal cables, and one of the spacers (8) is provided along the longitudinal center axis of the tension member.

14. A tension member according to claim 9, characterised in that one of the spacers (8) is provided along the longitudinal center axis of the tension member.

15. A tension member, comprising a plurality of fiber filaments (6) gathered into a plurality of strands (5) in which strands the filaments are placed in close relationship to one another, around which strands (5) there is provided a sheath (16), and pressure-resisting spacers (7) extending along the entire length of the tension member, either continuously or divided into sections, the spacers having recesses (9, 11, 12, 14 25, 26, 28, 31) receiving respective strands (5), whereby the strands can move in the longitudinal direction unobstructed by each other and the spacers (7), characterised in that the spacers (7, 8, 10) comprise longitudinal cavities (17, 18, 19, 20; 35) accommodating a pressure-equalising medium for equalising pressure with that of the surroundings, for accommodating additional strands (18, 21) and/or for accommodating signal cables.

16. A tension member, comprising a plurality of fiber filaments (6) gathered into a plurality of strands (5) in which strands the filaments are placed in close relationship to one another, around which strands (5) there is provided a sheath (16), and pressure-resisting spacers (7) extending along the entire length of the tension member, either continuously or divided into sections, the spacers having recesses (9, 11, 12, 14 25, 26, 28, 31) receiving respective strands (5), whereby the strands can move in the longitudinal direction unobstructed by each other and the spacers (7), characterised in that one of the strands (21, 23) is provided along the longitudinal center axis of the tension member.

17. A tension member according to claim 15, characterised in that one of the strands (21, 23) is provided along the longitudinal center axis of the tension member.

18. A tension member according to claim 17, characterised in that at least some of the recesses (9, 11, 12, 14; 25, 26, 28, 31) extend in a helical fashion along the length of the tension member.

* * * * *

UNITED STATES PATENT AND TRADEMARK OFFICE

CERTIFICATE OF CORRECTION

PATENT NO. : 6,385,928 B1
DATED : May 14, 2002
INVENTOR(S) : Bjorn Paulshus et al.

It is certified that error appears in the above-identified patent and that said Letters Patent is hereby corrected as shown below:

Title page,
Item [73], "Kvaener" should read -- Kvaerner --.

Signed and Sealed this

Twenty-third Day of July, 2002

*Attest:*

*Attesting Officer*

JAMES E. ROGAN
*Director of the United States Patent and Trademark Office*